US006000335A

United States Patent [19]

Imamaki et al.

[11] Patent Number: 6,000,335

[45] Date of Patent: Dec. 14, 1999

[54] STAMP MEMBER HAVING A POROUS SHEET

[75] Inventors: Teruo Imamaki, Kasugai; Koji Sugiyama, Nagoya, both of Japan

[73] Assignee: Brother Kogyo Kabushiki Kaisha, Aichi-ken, Japan

[21] Appl. No.: 09/141,894

[22] Filed: Aug. 28, 1998

[30] Foreign Application Priority Data

Aug. 29, 1997 [JP] Japan ..... 9-249984
Sep. 18, 1997 [JP] Japan ..... 9-272209

[51] Int. Cl.[6] ..... B41K 1/50

[52] U.S. Cl. ..... 101/327; 101/333; 101/401.1

[58] Field of Search ..... 101/327, 333, 101/395, 401.1, 487

[56] References Cited

U.S. PATENT DOCUMENTS 3,483,027 12/1969 Ritzerfeld et al. ..... 101/395
3,736,873 6/1973 Newman ..... 101/467
5,392,711 2/1995 Kainuma ..... 101/401.1
5,611,279 3/1997 Ando et al. ..... 101/401.1
5,873,308 2/1999 Taira ..... 101/401.1
5,899,142 5/1999 Suda et al. ..... 101/327

FOREIGN PATENT DOCUMENTS 1139892 1/1969 United Kingdom .
2 297 717 8/1996 United Kingdom .

*Primary Examiner*—Ren Yan
*Assistant Examiner*—Leslie J. Grohusky
*Attorney, Agent, or Firm*—Kane, Dalsimer, Sullivan and Levy, LLP

[57] ABSTRACT

A stamp member including a first porous sheet in which ink can be impregnated, and a second porous sheet which is harder than the first porous sheet. A compressive strength of the second porous sheet being not less than 5 kg/cm$^2$ when the second porous resin is compressed by 25%. The first and second porous sheets are fixed to each other at a plurality of points.

19 Claims, 8 Drawing Sheets

STAMP MEMBER HAVING A POROUS SHEET

BACKGROUND OF THE INVENTION

This invention relates to a stamp member used in a stamp apparatus.

Conventionally, a stamp member is made of a material which is sensitive to light such as ultraviolet rays. In order to make a stamp pattern on the stamp member, the stamp member is laid on an original sheet, and is irradiated with the light via the original sheet. Irradiated portions of the stamp member are cured while non-irradiated portions of the stamp member are not cured. The non-irradiated (non-cured) portions of the stamp member are removed by washing, so that a stamp pattern is formed on the stamp member.

In general, the original sheet is made of a transparent sheet on which a certain pattern (hereinafter referred to as an original pattern) is printed with ink. That is, there is a possibility that the original pattern of the original sheet melts when irradiated by the light. In such a case, the molten original pattern may be adhered to the stamp member. Thus, it is desired to prevent that the original pattern of the original sheet is adhered to the stamp member.

Further, when the stamp member (on which the stamp pattern is formed) is in use, there is a possibility that the stamp member swells due to the impregnated stamp ink.

Furthermore, when the stamp member is mounted to a stamp apparatus, a spacer may be provided between the stamp member and the stamp apparatus. The spacer is provided with through-holes for allowing stamp ink to reach the stamp member. In such a case, when the stamp member is urged onto a recording media, a urging force is not sufficiently applied to portions of the stamp member under the through-holes. Thus, the pressure applied to the stamp member is not uniform.

SUMMARY OF THE INVENTION

It is therefore an object of the present invention to prevent an adhesion of original pattern of an original sheet to a stamp member. Further, it is another object of the present invention to prevent the swelling of the stamp member and to uniformly urge the stamp member to a recording media.

According to an aspect of the present invention, there is provided a stamp member including (1) a porous sheet in which light energy absorbing material is dispersed and in which ink can be impregnated, (2) a transparent sheet attached to a surface of the porous sheet, a melting point of the transparent sheet being higher than the porous sheet, and (3) a coated layer attached to the transparent sheet at an opposing side to the porous sheet. A stamp pattern can be formed by biasing the stamp member to an original sheet having a original pattern formed thereon and by irradiating the stamp member with light through the original sheet, so that pores of an irradiated portion of the porous sheet are sealed and thereby block transmission of ink, while pores of a non-irradiated portion of the porous sheet remain open and thereby allow transmission of ink. The coated layer is made of a compound such that an adhesion of the original pattern to the coated layer is lower than the adhesion of the original pattern to the transparent sheet, at least at a melting point of the porous resin member.

As constructed above, since the coated layer exists between the original pattern of the original sheet and the porous sheet, and since the adhesion of the original pattern to the coated layer is lower than that to the transparent sheet, the original pattern is unlikely to adhere to the coated layer. Thus, the original sheet is not damaged and can be used repeatedly. Further, the coated layer also acts as a protective layer which protects the transparent sheet.

In particular, the compound (of the coated layer) includes one of silicon resin and fluorocarbon resin. The adhesion of the pattern of the original sheet to the compound is sufficiently low.

Preferably, the transparent sheet is made of polyethylene terephthalate (PET). Since the melting of the PET is sufficiently high, the transparent sheet is not damaged by the heat generated when the porous sheet is irradiated. Further, the porous sheet is made of polyolefin resin, polyvinyl chloride resin or polyurethane resin. The melting points of these materials are lower than PET.

According to another aspect of the present invention, there is provided a stamp member including (1) a first porous sheet in which ink can be impregnated, and (2) a second porous sheet which is harder than the first porous sheet. A compressive strength of the second porous sheet is not less than 5 kg/cm$^2$ when the second porous resin is compressed by 25%. The first and second porous sheets are fixed to each other at a plurality of points. A stamp pattern can be formed by irradiating the first porous sheet with light through an original sheet, so that pores of the irradiated portion are sealed and thereby block transmission of ink, while pores of a non-irradiated portion of the porous sheet remain open and thereby allow the transmission of ink. In particular, the first and second porous sheets are fixed by means of an adhesive agent.

As constructed above, since the first porous sheet is fixed to the second porous sheet which is harder than the first porous sheet, the swelling of the first porous sheet is prevented. Further, since the adhesive agent does not cover the whole surface of the second porous sheet but exists at plurality of points, the adhesive agent does not interfere with the ink being transmitted to the first porous sheet.

If a compressive strength of the second porous sheet is not less than 10 kg/cm$^2$ (when the second porous resin is compressed by 25%), a better result is obtained in preventing the swelling of the first porous sheet.

Advantageously, the stamp member further includes a third porous sheet. The third porous sheet is provided to the second porous sheet at an opposing side to the first porous sheet. Thus, the thickness of the stamp member can be increased without increasing the thickness of the first porous sheet. Accordingly, the sagging of cutting edges of the stamp member is prevented.

It is preferable that a plurality of through-holes are formed on the third porous sheet. With this, it becomes possible to vary the quickness of the ink transmission of the stamp member by changing the diameter and the number of the holes. Advantageously, the first and second porous sheets are made of porous resin, so that the stamp member can be welded to a holder of the stamp apparatus.

In a preferred embodiment, a spacer is provided to the second porous sheet at opposing side to the first porous sheet. The spacer has a plurality of through-holes which allow ink to reach the first porous sheet via the second porous sheet. Even if the stamp member is urged to the original sheet via such spacer, sufficient pressure is applied to portions of the first porous sheet located under the through-holes, due to the existence of the second porous sheet.

Conveniently, a melting point of the first porous sheet is from 50 to 200° C. The sponge hardness of the first porous sheet is from 20 to 50 degrees. The average pore size of the first porous sheet is from 0.01 to 0.05 mm. With this, a stamped pattern formed on a recording media becomes sharp.

Preferably, the thickness of the first porous sheet is from 0.5 to 2 mm. With this, the ink smoothly transmits the first porous sheet. Also, the force required for stamping is relatively small. Further, the thickness of the second porous sheet is from 0.5 to 4 mm. With this, the swelling of the first porous sheet can be effectively prevented. Also, the ink smoothly transmits the second porous sheet.

DESCRIPTION OF THE PREFERRED EMBODIMENT

The embodiment of the present invention is described with reference to the accompanying drawings.

Figure 1A:
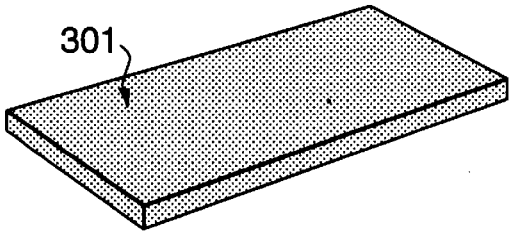
FIGS. 1A, 1B, 1C and 1D are schematic views showing a principle of a stamp pattern making process.

First, a principle of stamp pattern making process is described. FIG. 1A is a perspective view of a stamp member 301 made of porous resin in which stamp ink can be impregnated. The stamp member 301 includes carbon black (or other light-energy absorbing material) dispersed therein.

Figure 1B:
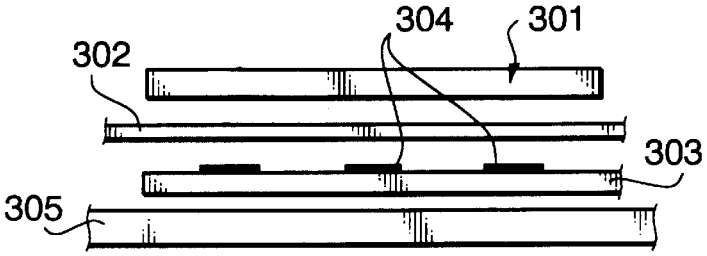
Figure 1C:
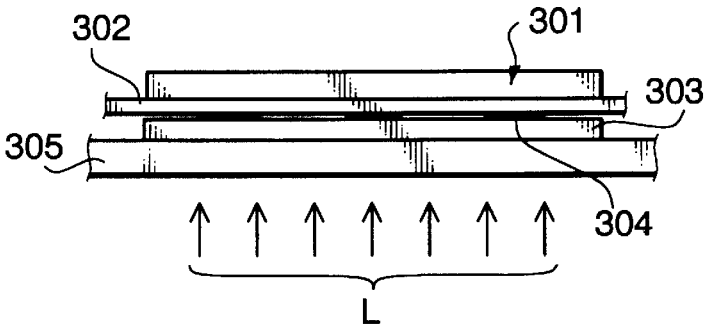
Figure 1D:
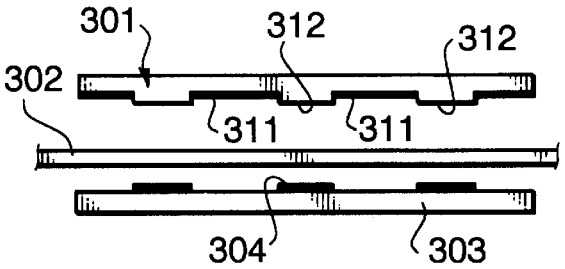

FIGS. 1B through 1D are schematic views showing the principle of the stamp pattern making process. As shown in FIG. 1B, an original sheet 303 is placed on a transparent support plate 305. A transparent sheet 302 is further placed on the original sheet 303. The stamp member 301 is laid on the transparent sheet 303. The melting point of the transparent sheet 302 is higher than that of the stamp member 301. A not-shown light source is provided at a side of the transparent support plate 305 opposing the stamp member 301.

The stamp member 301 is biased by a not-shown biasing member to the transparent support plate 305. As shown in FIG. 1C, the light (denoted by L) irradiates the stamp member 301 through the original sheet 303 and the transparent sheet 302. The light incident on a pattern (original pattern) 304 formed on the original sheet 303 is blocked. Conversely, the light passing through transparent portions of the original sheet 303 further passes through the transparent sheet 302 and irradiates the stamp member 301. Due to the light energy absorbing material, irradiated portions 311 of the stamp member 301 are heated and melted to be solidified. Non-irradiated portions 312 of the stamp member 301 are not heated. When the biasing force is removed, the non-irradiated portions 312 recover their original thickness, while the irradiated (and solidified) portions 311 remain the same as the stamp member 301 is biased. Thus, the non-irradiated portions 312 become projections as shown in FIG. 1D. Further, pores of the irradiated portions 311 are sealed, while pores of the non-irradiated portions 312 remain open. Thus, ink-transmitting portions 312 and ink-blocking portions 311 are formed on the stamp member 301, which make the stamp pattern.

Figure 2:
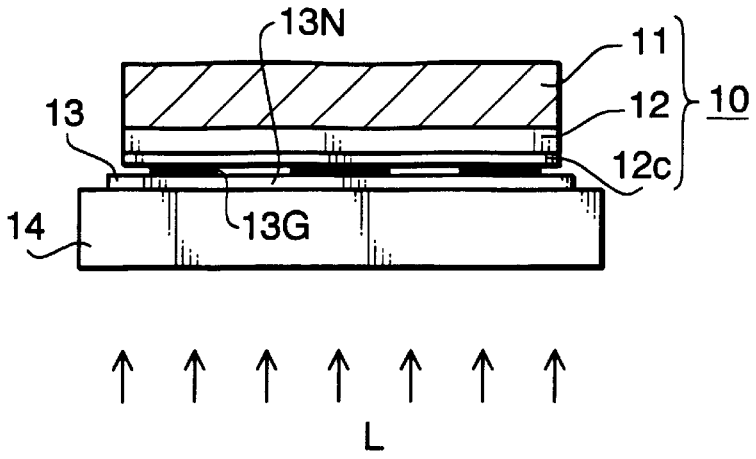
FIG. 2 is a schematic view showing a stamp member according to a first embodiment.

FIG. 2 is a schematic view showing a stamp member as well as an arrangement for making a stamp pattern, according to the first embodiment.

A stamp member 10 includes a porous sheet 11 in which carbon black (or other light energy absorbing material) is dispersed and in which stamp ink can be impregnated. A transparent sheet 12 is attached to the porous sheet 11. Further, a coated layer 12*c* is provided to the transparent sheet 12 at an opposing sides to the porous sheet 11.

An original sheet 13 having a certain pattern (original pattern) 13G is laid on a transparent support plate 14 made of acrylic resin. The stamp member is laid on the original sheet 13 so that the coated layer 12*c* is faced with the original sheet 13. Further, The original pattern 13G of the original 13 is faced with the stamp member 10. A not-shown light source (such as a xenon tube) is provided to a side of the support plate 14 opposing to the stamp member 10. The light (such as infrared rays) from the light source irradiates the stamp member 10 via the original sheet 13.

The porous sheet 11 is made of foamable resin (such as polyolefin resin, polyvinyl chloride resin and polyurethane resin) or rubber, which has a flexibility when formed in the shape of a sheet. The thickness of the porous sheet 11 is approximately from 1 to 5 mm.

The content of the carbon black in the porous sheet 11 is approximately from 0.1 to 15 wt %, and more preferably from 1.0 to 15 wt %. It is alternatively possible to employ silver chloride or silver bromide, instead of carbon black.

The transparent sheet 12 has a higher melting point than the porous sheet 11. The melting point of the porous sheet 11 is approximately 120° C. (when the porous sheet 11 is made of soft polyurethane resin) or approximately 70° C. (when the porous sheet 11 is made of soft polyolefin resin). Preferably, the transparent sheet 12 is made of transparent polyethylene terephthalate whose melting point is 230° C., which is sufficiently higher than that of porous sheet 11. The thickness of the transparent sheet 12 is approximately from 0.025 to 0.2 mm.

The original sheet 13 is made of a transparent film on which the original pattern 13G is printed by means of an ink ribbon and a thermal head (not shown).

The coated layer 12*c* is made of a compound such that the adhesion of the original pattern 13G to the compound is lower than the adhesion of the original pattern 13G to the transparent sheet 12. This requirement should be satisfied at least at a melting point of the porous sheet 11. Preferably, the coated layer 12*c* is made of silicone resin or fluorocarbon resin, such as 'E15' (product name) manufactured by Fuji Kopian Kabushiki Kaisha. The coated layer 12*c* is coated on the transparent sheet 12 by means of a gravure roll coater or a bar-coater. The thickness of the coated layer 12*c* is approximately 0.1 g/m$^2$.

The stamp pattern making process is described with reference to FIGS. 2 and 3A. The light L (such as infrared rays) emitted from the not-shown light source (such as a xenon tube) passes through the transparent support plate 14 and irradiates the original sheet 13. The light incident on the original pattern 13G is blocked. On the other hand, the light passing through the transparent portions 13N further passes through the coated layer 12*c* and the transparent sheet 12 and irradiates the porous sheet 11. Due to the light energy absorbing material, irradiated portions of the porous sheet 11 are heated and melted, so that pores included therein are sealed. Non-irradiated portions of the porous sheet 11 are not heated, so that pores included therein remain open. Thus, ink-transmitting portions and ink-blocking portions are formed on the stamp member, which make a stamp pattern.

In the above mentioned process, the original pattern 13G on the original sheet 13 may also be heated when irradiated with the light. However, the heat of the original pattern 13G is diffused in the transparent sheet 12. Thus, the porous sheet 11 is not heated by the transmitted heat from the original pattern 13G.

Figure 3A:
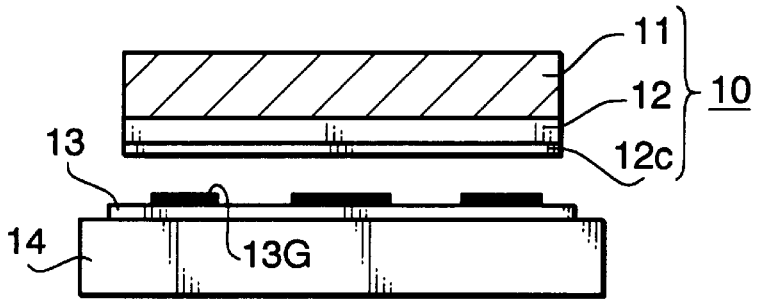
FIG. 3A is a schematic view of a stamp member having a protective coat, which is separated from an original sheet.

FIG. 3A is a schematic view showing the stamp member 10 being separated from the original sheet 13. As shown in FIG. 3A, due to the existence of the coated layer 12*c*, the original pattern 13G of the original sheet 13 does not adhere to the stamp member 10 when the stamp member 10 is separated from the original sheet 13. This is particularly effective if the coated layer 12*c* is made of silicone resin or fluorocarbon resin. Thus, the original sheet 13 is not damaged and can be used repeatedly. Further, the coated layer 12*c* also acts as a protective layer which protects the transparent sheet 12.

Figure 3B:
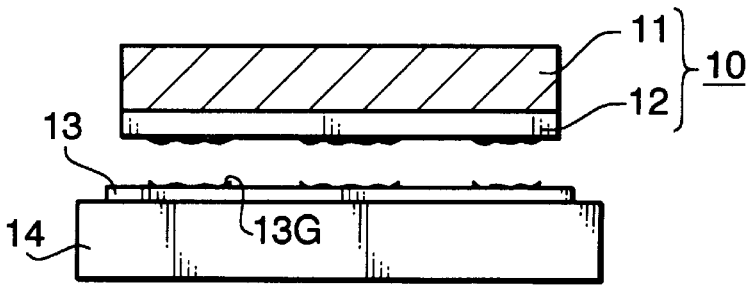
FIG. 3B is a schematic view of a stamp member having no protective coat, which is separated from the original sheet.

For comparison, FIG. 3B shows the stamp member 10 having no coated layer 12*c* being separated from the original sheet 13. In this case, the original pattern 13G of the original sheet 13 adheres to the stamp member 10 when the stamp member 10 is separated from the original sheet 13. Thus, the original sheet 13 is damaged and can not be used repeatedly.

In the above described stamp pattern making process, the original pattern 13G on the original sheet 13 can be made of any type of ink (for example, oil base ink or paint), as long as the adhesion of the ink to the coated layer 12*c* is lower than the adhesion of the ink to the transparent sheet 12.

Further, the numbers of the irradiated portions and the non-irradiate portions of the porous sheet 11 depend on the original pattern 13G of the original sheet 13. In some cases, the number of the irradiated portion may be one. Also, the number of the non-irradiated portion may be one.

Figure 4:
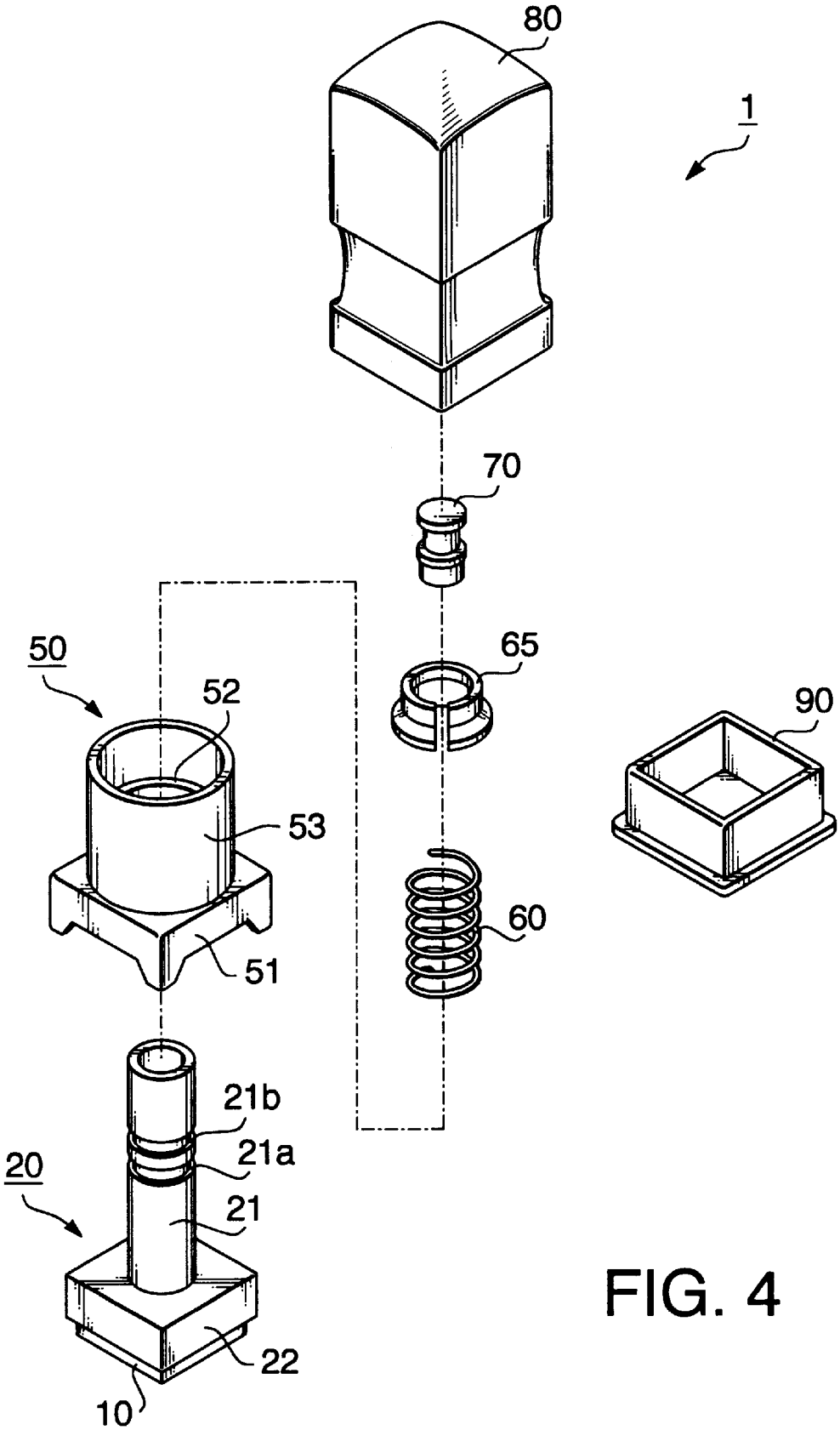
FIG. 4 is an exploded perspective view of a stamp apparatus of the first embodiment.
Figure 6:
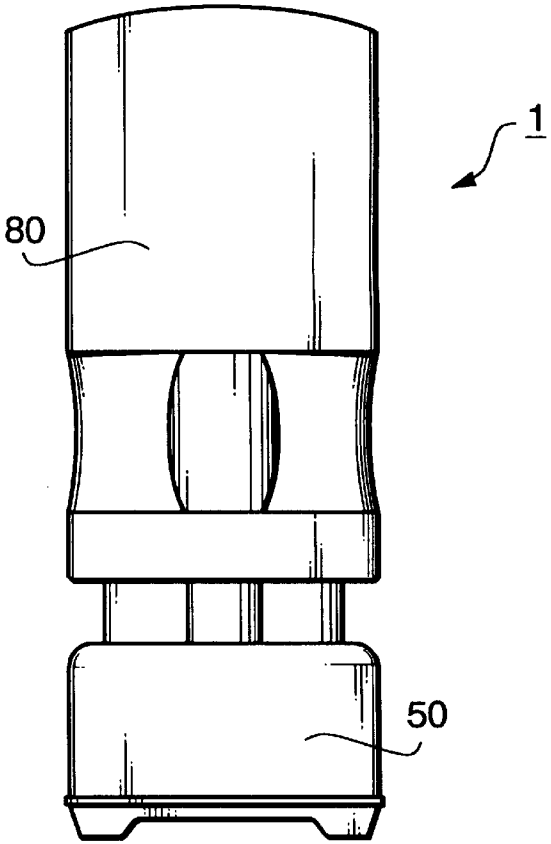
FIG. 6 is a side view of the stamp apparatus of FIG. 4.
Figure 5:
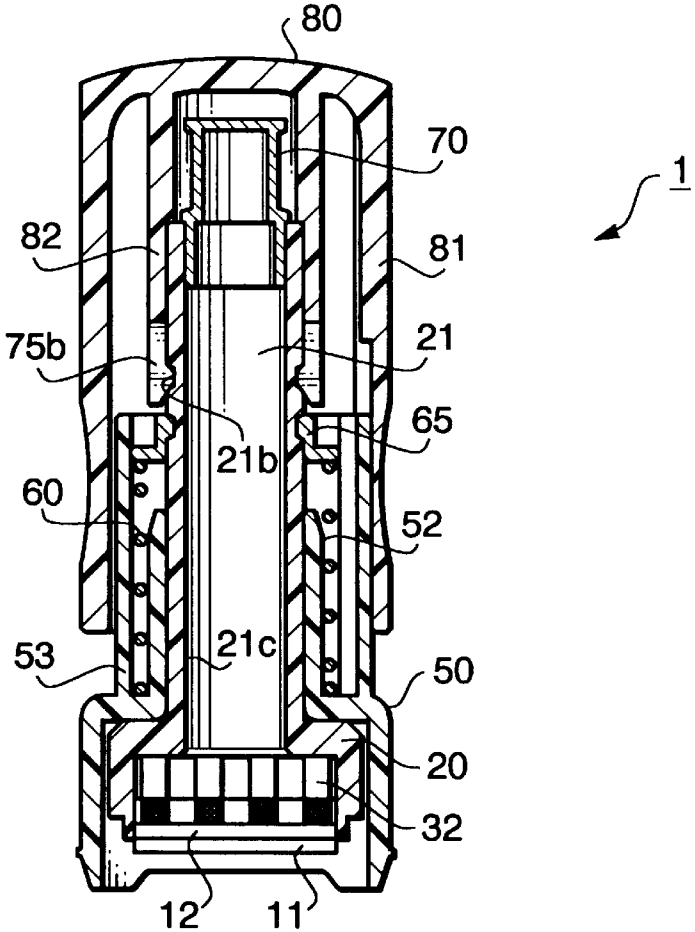
FIG. 5 is a sectional view of the stamp apparatus according to the first embodiment.

A stamp apparatus 1 employing the stamp member 10 is described. FIGS. 4, 5 and 6 are an exploded perspective view, a sectional view and a side view of the stamp apparatus 1. As shown in FIGS. 4 and 5, the stamp apparatus 1 includes the stamp member 10, a holder 20 which supports the stamp member 10, a skirt 50 provided around the holder 20 and a grip 80 which is to be gripped by a user. The holder 20 includes a box-shaped holder body 22 and a support cylinder 21 extended upward from the holder body 22. The support cylinder 21 has two laterally extending grooves 21*a* and 21*b*. The top end of the support cylinder 21 is sealed by a cap 70.

The skirt 50 includes a skirt body 51 and inner and outer cylinders 52 and 53 extended upward from the skirt body 51. The skirt body 51 is so constituted that the holder body 22 of the holder 20 is inserted therein. The inner cylinder 52 is so constituted that the support cylinder 21 is inserted in the inner cylinder 52. A coil (compression) spring 60 is provided between the inner cylinder 52 and the outer cylinder 53. The top of the coil spring 60 abuts a ring member 65 provided around the support cylinder 21 of the holder 20, while the bottom of the coil spring 60 abuts the top surface of the skirt body 51. With this, the coil spring 60 urges the skirt 50 downward with respective to the holder 20.

The grip 80 includes a cap-shaped case 81 and an inner cylinder 82 extended downward from the top of the case 81. The inner cylinder 82 receives an upper portion of the support cylinder 21 of the holder 20. The inner cylinder 82 has projections which engage the laterally extending groove 21b of the holder 20. Thus, the grip 80 and the holder 20 are fixed with each other.

On supplying ink to the stamp member 10, the grip 80 can be easily separated from the holder 20 by disengaging the projections 75*b* and the laterally extending grooves 21*b*. Further, the cap 70 can be easily detached from the top of the support cylinder 21. Ink is supplied to the stamp member 10 through a ink supply hole 21*c* in the support cylinder 21.

Figure 7:
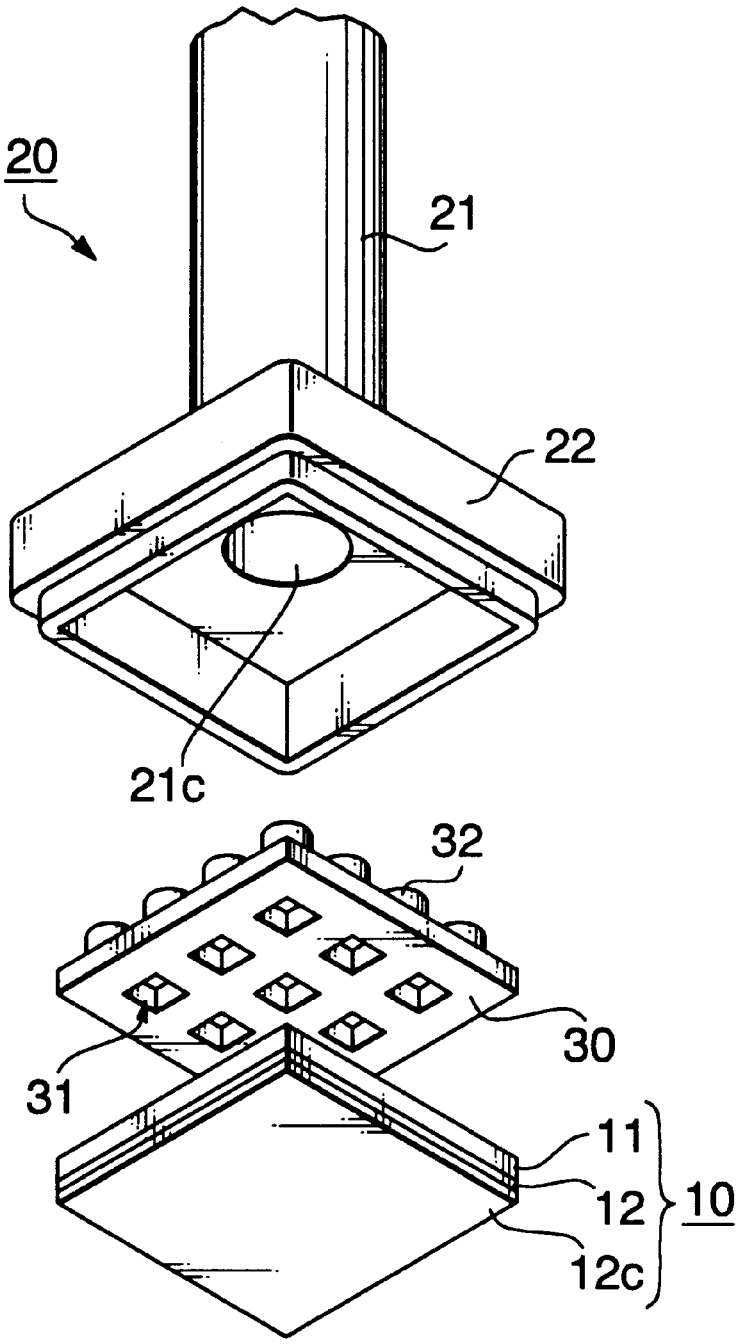
FIG. 7 is an exploded perspective view of a holder of the stamp apparatus of FIG. 4.

FIG. 7 is an exploded perspective view of the holder 20 of the stamp apparatus 1. The stamp member 10 is mounted to an rectangular recess of the holder body 22 in such a manner that the coated layer 12*c* is faced outward. Since the components of the stamp member 10 are made of resin materials, the stamp member 10 can be easily welded to the holder body 22. The coated layer 12*c* is made of silicone resin. A spacer 30 is provided between the stamp member 10 and the recess of the holder body 22. The spacer 30 is made of a plate member having several holes 31. The diameter of each hole 31 is approximately from 1 to 5 mm. Further, several pillars 32 are formed on the spacer 30 at an opposing side to the stamp member 10. The pillars 32 abut the ceiling of the recess of the holder body 22. The ink supply hole 21*c* opens at the ceiling of the recess of the holder body 22. The holes 31 of the spacer 30 allow the stamp ink (from the ink supply hole 21*c*) to reach the stamp member 10. When the stamp apparatus 1 is not in use, a cover 90 is mounted to the holder 20, so as to cover the stamp member 10.

With such an arrangement, when a user grips the grip 80 and pushes the grip 80 to a recording media, the holder 20 is pushed downward resisting the coil spring 60. With this, the stamp member 10 is urged onto the recording media. When the user releases the grip 80, the holder 20 returns to its original position by the spring force of the coil spring 60.

In a stamp pattern making process, the stamp 10 is urged to the transparent support plate 14 (FIG. 2), so that the stamp member 10 is urged to the original sheet 13 on the transparent support plate 14. Although the stamp material 10 is urged to the original sheet 13, the original pattern 13G does not adhere to the stamp member 10 due to the existence of the intermediate coated layer 12*c*.

The experimental result of the first embodiment is described.

In this experiment, a plate-shaped porous polyurethane resin is employed as the porous sheet 11. The porous sheet 11 is rectangular plate of 35 mm×35 mm, having the thickness of 1 mm. The average pore size of the porous sheet 11 is 20 $\mu$m. The sponge hardness of the porous sheet 11 is 30 degrees.

Polyethylene terephthalate (PET) film having the thickness of 0.075 mm is used as the transparent sheet 12, and is attached to the porous sheet 11. Silicone resin add under the tradename 'E15' (product name) manufactured by Fuji Kopian Kabushiki Kaisha is used as the coated layer 12*c*. The coated layer 12*c* is coated on the transparent sheet 12 by a gravure roll coater or a bar coater.

The stamp pattern is formed as shown in FIG. 2. The condition of the emission of the xenon tube is such that the capacity of the condenser is 9000 $\mu$F, and the voltage is 330 V. The original pattern 13G of the original sheet 13 is made by printing using ink ribbon.

As a result of the experiment, the original pattern 13G on the original sheet 13 does not adhere to the stamp member 10 when the stamp member 10 is separated from the original sheet 13. This is particularly effective if the coated layer 12*c* is made of silicone resin or fluorocarbon resin. There is no damage on the original pattern 13G of the original sheet 13.

On the other hand, when the same experiment is performed without providing the coated layer 12*c*, the original pattern 13G of the original sheet 13 adheres to the stamp member 10 when the stamp member 10 is separated from the original sheet 13. Thus, the original sheet 13 is damaged and can not be used repeatedly.

The second embodiment of the present invention is described.

Figure 8:
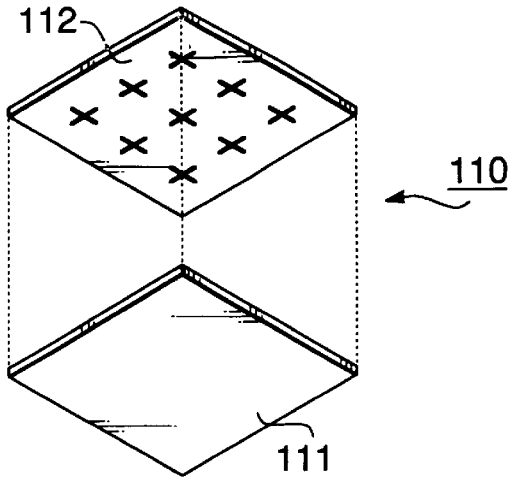
FIG. 8 is an exploded perspective view of a stamp member of the second embodiment.

FIG. 8 is an exploded perspective view of the stamp member 110 of the second embodiment. The stamp member 110 includes a soft porous sheet 111 and a hard porous sheet 112, both of which are plate shaped.

The soft and hard porous sheets 111 and 112 are adhered with each other by means of an adhesive agent applied at several points in rows. Since the adhesive agent does not cover the surface of the hard porous sheet 112 but exists at these points, the adhesive agent does not interfere with the ink being transmitted to the soft porous sheet 111. Further, since the adhesive agent exists uniformly on the soft porous sheet 111, the swelling of the soft porous sheet 111 can be prevented. Preferably, the pitch of the points of the adhesive agent is from 1 to 10 mm. The type of the adhesive agent is determined according to the affinity to the soft and hard porous sheets 111 and 112.

Figure 9:
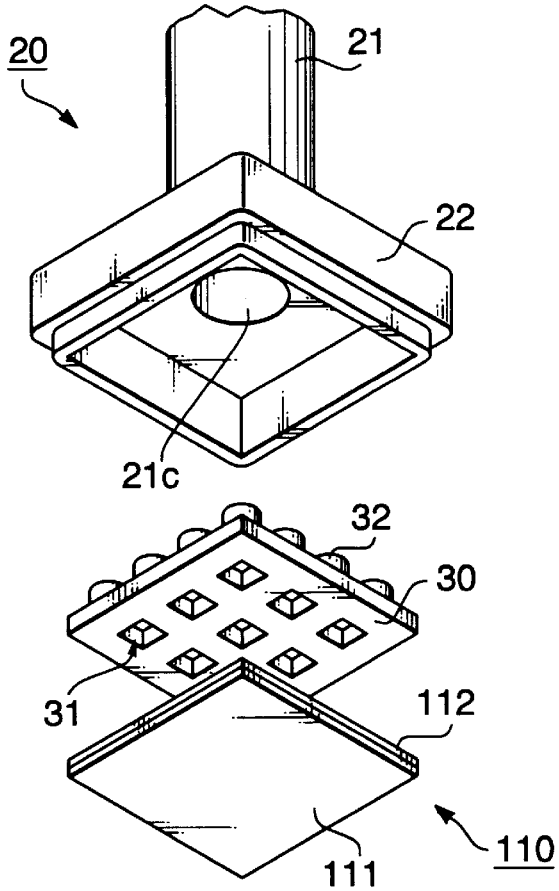
FIG. 9 is an exploded perspective view of a holder of a stamp of the second embodiment.
Figure 10:
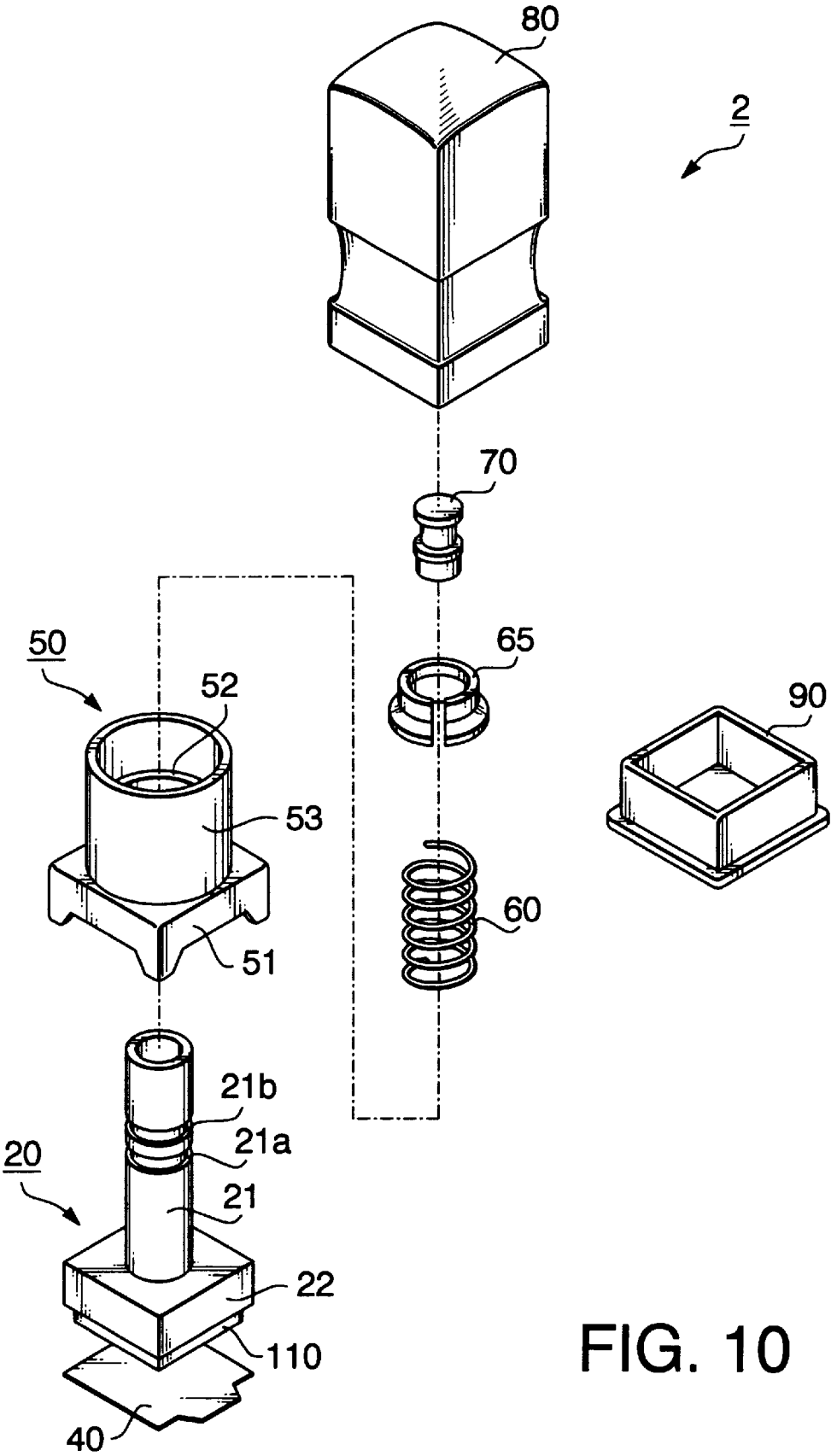
FIG. 10 is an exploded perspective view of a the stamp apparatus of the second embodiment.

A stamp apparatus 2 of the second embodiment is described. FIG. 9 is an exploded perspective view of the holder 20 of the stamp apparatus 2. FIG. 10 is an exploded perspective view of the stamp apparatus 2. As shown in FIG. 10, the stamp apparatus 2 includes the holder 20, the skirt 50, the grip 80 and the cover 90. These parts have the same structure as those in the first embodiment.

As shown in FIG. 9, the stamp member 110 is mounted to a rectangular recess of the holder body 22 in such a manner that the soft porous sheet 111 is faced outward. The spacer 30 is provided between the stamp member 110 and the recess of the holder body 22. The spacer 30 has the same structure as that of the first embodiment, having several holes 31 and several pillars 32. Further, a PET film 40 cut into a predetermined shape is provided to the outer surface of the soft porous sheet 111. The surface of the PET film 40 is coated with silicon resin, so that the original pattern does not adhere to the PET film 40.

Figure 11:
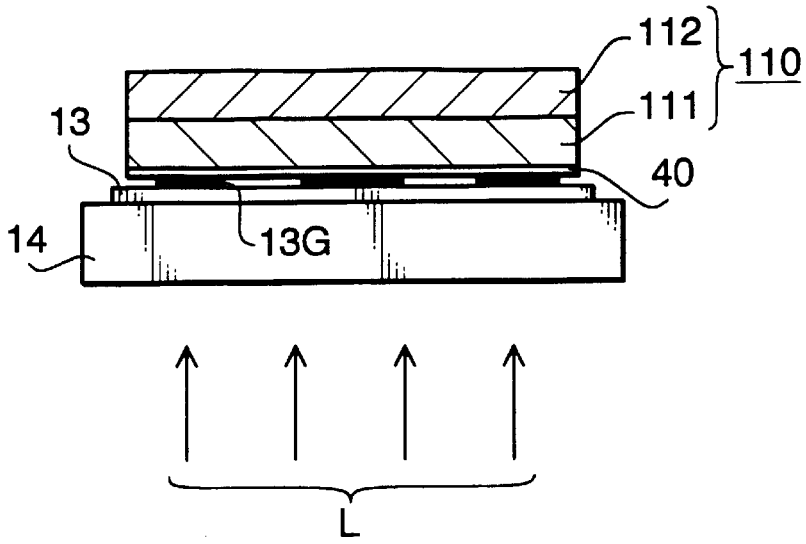
FIG. 11 is a schematic view showing an example of a stamp making process of the second embodiment.

FIG. 11 is a schematic view showing an example of the stamp pattern making process of the second embodiment. In this example, the soft porous sheet 111 includes light energy absorbing material such as carbon black dispersed therein. The stamp member 110 (and the PET film 40) is placed on the original sheet 13 laid on the transparent support plate 14. The original sheet 13 and the transparent support plate 14 are the same as those in the first embodiment. In this state, the original sheet 13, the PET film 40, the soft porous sheet 111 and the hard porous sheet 112 are laid on the transparent support plate 14 in this order.

The light L emitted from a not-shown xenon tube passes through the transparent support plate 14 and irradiates the original sheet 13. The light incident on the original pattern 13G of the original sheet 13 is blocked. Conversely, the light passing through the transparent portions of the original sheet 13 further passes through the PET film 40 and irradiates the soft porous sheet 111. Irradiated portions of the soft porous sheet 111 are heated and melted, so that pores included therein are sealed. Non-irradiated portions of the soft porous sheet 111 are not heated, so that pores included therein remain open. Thus, ink-transmitting portions and ink-blocking portions are formed on the stamp member, which make the stamp pattern.

Preferably, the soft porous sheet 111 is made of polyurethane resin. Since the stamp pattern is formed on the soft porous sheet 111 by the above described irradiation process, the melting point of the soft porous sheet 111 is preferably from 50 to 200° C. More preferably, the melting point of the soft porous sheet 111 is from 80 to 150° C. Further more preferably, the melting point of the soft porous sheet 111 is 110° C. The melting point of the soft porous sheet 111 is measured by Yanagimoto Digital Micro Melting Point Measuring Apparatus 'MP-500D' (product name) manufactured by Kabushiki Kaisha Yanako Kikikaihatsu Kenkyusho.

The sponge hardness of the soft porous sheet 111 is preferably not less than 20 degrees, in order that stamp ink smoothly transmits the soft porous sheet 111. Further, the sponge hardness of the soft porous sheet 111 is preferably not more than 50 degrees, in order that the soft porous sheet 111 tightly contacts the recording media. The sponge hardness is measured by 'Asuka-C' (product name) manufactured by Kobunshi Keiki Kabushiki Kaisha.

The average pore size of the soft porous sheet 111 is preferably not less than 0.01 mm, in order that stamp ink smoothly transmits the soft porous sheet 111. Further, the average pore size of the soft porous sheet 111 is preferably not more than 0.05 mm, in order to obtain a sharp stamped pattern.

The hard porous sheet 112 has a compressive strength of 5 Kgf/cm$^2$ when the hard porous sheet 112 is compressed by 25% (that is, the thickness of the hard porous sheet 112 decreases by 25%). With this strength, when the hard porous sheet 112 is attached to the soft porous sheet 111 as described above, the swelling of the soft porous sheet 111 is prevented.

Further, since the hard porous sheet 112 exists between the soft porous sheet 111 and the spacer 30, when the stamp member 110 is urged to the recording media, the pressure is uniformly applied to the stamp member 110, without the influence of the holes 31 of the spacer 30 (FIG. 9). That is, portions of the stamp member 110 located under the holes 31 of the spacer 30 are sufficiently compressed.

Similarly, on the stamp pattern making process, the -soft porous sheet 111 is uniformly urged to the original sheet 13. Thus, when the soft porous sheet 111 is irradiated -with the light, the light leakage does not occur. Accordingly, a clear stamp pattern is formed on the stamp member 110.

The hard porous sheet 112 is made of porous resin such as porous polyvinyl formal, for example, Kanebou Beruita A-series (product name) manufactured by Kanebou Kabushiki Kaisha. Further, the hard porous sheet 112 can be made of porous polyvinyl chloride such as sintered polyvinyl chloride, or porous nylon such as sintered nylon.

The thickness of the soft porous sheet 111 is 0.5 to 2.0 mm. If the soft porous sheet 111 is thicker than 2.0 mm, ink does not smoothly transmit the soft porous sheet 111. If the soft porous sheet 111 is thinner than 0.5 mm, a relatively large force is needed for urging the stamp member 110 to the recording sheet. Further preferably, the thickness of the soft porous sheet 111 is approximately 1.0 mm.

The thickness of the hard porous sheet 112 is 0.5 to 4.0 mm. If the hard porous sheet 112 is thicker than 4.0 mm, ink does not smoothly transmit through the hard porous sheet 112. If the hard resin 12 is thinner than 0.5 mm, the swelling and deformation of the soft porous sheet 111 are not well prevented. Further preferably, the thickness of the hard porous sheet 112 is approximately 1.0 mm. It is alternatively possible to use the hard porous sheet 112 of other porous material such as a porous ceramic.

The experimental result of the second embodiment is described.

In this experiment, a plate-shaped porous polyurethane resin is employed as the soft porous sheet 111. The porous sheet 111 is rectangular plate of 35 mm×35 mm, having the thickness of 1 mm. The average pore size of the soft porous sheet 111 is 20 $\mu$m. The sponge hardness of the soft porous sheet 111 is 30 degrees. The melting point of the soft porous sheet 111 is 110° C.

Polyvinyl formal film having the thickness of 0.075 mm is employed as the hard porous sheet 112, and attached to the soft porous sheet 111. The hard porous sheet 112 is rectangular plate of 35 mm×35 mm, having the thickness of 1 mm.

Ten types of hard porous sheets 112 are used in this experiment. These hard porous sheets 112 belong to Kanebou Beruita A-series (product name) manufactured by Kanebou Kabushiki Kaisha. The compressive strengths of respective types of the hard porous sheets 112 are shown in the Table 1. The porosities of respective types of the hard porous sheets 112 are substantially the same (ranging from 85% to 91%).

The stamp member 110 is assembled in the stamp apparatus as described above (FIGS. 8 and 9). Further, the stamp pattern is formed by the irradiation process shown in FIG. 11. The condition of the emission of the xenon tube is such that the capacity of the condenser is 9000 $\mu$F, and the voltage is 330 V.

In this experiment, the sharpness of the stamped pattern on the recording media is observed. Particularly, it is checked if the influence of the holes 31 (FIG. 9) of the spacer 30 appears in the stamped pattern. Also, it is checked if the ink transmits the ink-blocking portions of the stamp member 110.

The result 'C' means that the influence of the holes 31 of the spacer 30 faintly appears, and that ink oozes out of the ink blocking portions of the stamp member 110 by a small amount, when the stamp member 110 is urged by a normal force. The result 'D' means that the influence of the holes 31 of the spacer 30 clearly appears, and that ink oozes out of the ink blocking portions of the stamp member 100 by a small amount when the stamp member 110 is urged by a normal force.

As shown in Table 1, when the compressive strength of the hard porous sheet 112 is not less than 5 kgf/cm$^2$, there is no problem in the shape of the stamped pattern. Further, the swelling does not occur. Particularly, when the strength of the hard porous sheet 112 is not less than 10 kgf/cm$^2$, a more clear stamped pattern is obtained.

In the above described stamp pattern making process (FIG. 11) of the second embodiment, the numbers of the irradiated portions and the non-irradiate portions of the soft porous sheet 111 depend on the original pattern 13G of the original sheet 13. In some cases, the number of the irradiated portion may be one. Also, the number of the non-irradiated portion may be one.

Figure 12:
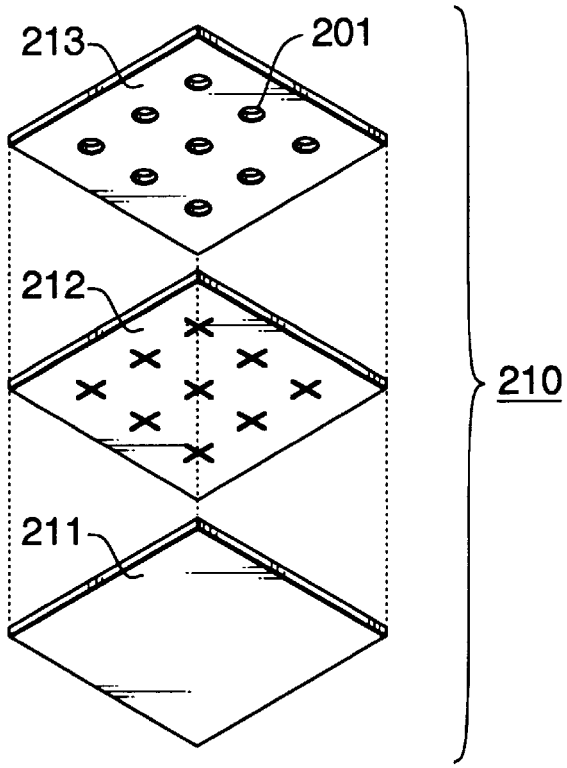
FIG. 12 is an exploded perspective view of a stamp member of an alternative arrangement of the second embodiment.

The alternative arrangement of the second embodiment is described with reference to FIG. 12. As shown in FIG. 12, a stamp member 210 of this alternative arrangement includes three layers: a hard porous sheet 212, a soft porous sheet 211, and a top sheet 213. The top sheet 213 is attached to the hard porous sheet 212 at an opposing side to the soft porous sheet 211. The soft and hard porous sheets 211 and 212 are the same as the soft and hard porous sheets 111 and 112 of the second embodiment.

The top sheet 213 is made of porous polyvinyl formal. Since the top sheet 213 is porous, the top sheet 213 allows ink to transmit to the soft and hard porous sheets 211 and 212, and to a recording media.

Further, in order to shorten the time required for the ink to transmit the stamp member 210, the top sheet 213 has several through-holes 201. In particular, if the size of the stamp member 210 is 35 mm×35 mm, nine through-holes 201 having the diameter of 1.8 mm are formed on the top sheet 213 as shown in FIG. 12. If the size of the stamp member 210 is 12 mm×12 mm, two through-holes 201 having the diameter of 1.8 mm are formed on the top sheet 213. If the size of the stamp member 210 is 40 mm×90 mm, twenty through-holes 201 having the diameter of 1.8 mm are formed on the top sheet 213.

In order to decrease the force of urging stamp member 210 to the recording media, it is preferable that the thickness of the stamp member 210 is relatively thick. However, as the soft porous sheet 211 becomes thicker, the *: sagging of cutting edges of the stamp member easily occurs. The edges of the stamp member is generally cut by punching, using a blade fixed to veneer (so-called Thomson Machining).

However, according to the alternative arrangement, the thickness of the stamp member 210 can be increased by the

TABLE 1

Stamp Performance at Different Compressive Strengths of Hard Porous Sheets

| Hard Porous Sheet | Product Name<br>Series No. | A-3140<br>BA(A) | A-3160<br>CA(A) | A-3210<br>DA(A) | A-3230<br>DC(A) | A-3320<br>EB(A) | A-3420<br>FB(A) | A-3520<br>GB(A) | A-42000<br>KA(A) | A-4300<br>KE(A) | A-4400<br>KF(A) |
|---|---|---|---|---|---|---|---|---|---|---|---|
| Compressive Strength (kgf/cm$^2$) when compressed by 25% | | 5 | 3 | 12 | 18 | 6 | 4 | 4 | 10 | 8 | 5 |
| Result | | C | D | A | A | B | D | D | A | B | C |

In Table 1, the result 'A' means that no influence of the holes 31 of the spacer 30 appears, and that ink does not ooze out of the ink blocking portions of the stamp member 110. The result 'B' means that no influence of the holes 31 of the spacer 30 appears, and that ink oozes out of the ink blocking portions of the stamp member 10 by a small amount when the stamp member 110 is urged by a relatively large force.

thickness of the top sheet 213 without increasing the thickness of the soft porous sheet 211. Thus, the sagging of cutting edges of the stamp member 210 is prevented. Additionally, it becomes possible to vary the quickness of the ink transmission of the stamp member 210 by changing the diameter and the number of the holes 201.

Although the structure and operation of the stamp member is described herein with respect to the embodiments, many modifications and changes can be made without departing from the spirit and scope of the invention.

What is claimed is:

1. A stamp member comprising:

a porous sheet in which light energy absorbing material is dispersed and in which ink can be impregnated;

a transparent sheet attached to said porous sheet, a melting point of said transparent sheet being higher than a melting point of said porous sheet; and a coated layer provided to said transparent sheet at an opposing side to said porous sheet, wherein a stamp pattern can be formed by biasing said stamp member to an original sheet having an original pattern formed thereon and by irradiating said stamp member with light through said original sheet, so that pores of an irradiated portion of said porous sheet are sealed and thereby block transmission of ink, while pores of a non-irradiated portion of said porous sheet remain open and thereby allow the transmission of ink, and wherein said coated layer is made of a compound such that an adhesion of said original pattern to said compound is lower than the adhesion of said original pattern to a compound of said transparent sheet, at least at the melting point of said porous sheet.

2. The stamp member according to claim 1, wherein said coated layer compound is made of one from the group consisting of silicon resin and fluorocarbon resin.

3. The stamp member according to claim 1, wherein said transparent sheet is made of polyethylene terephthalate.

4. The stamp member according to claim 1, wherein said porous sheet includes one from the group consisting of polyolefin resin, polyvinyl chloride resin and polyurethane resin.

5. The stamp member according to claim 1, wherein said light energy absorbing material is carbon black.

6. A stamp member comprising:

a first porous sheet in which ink can be impregnated; and a second porous sheet which is harder than said first porous sheet, a compressive strength of said second porous sheet being not less than 5 kg/cm$^2$ when said second porous sheet is compressed by 25%, wherein said first and second porous sheets are fixed to each other at a plurality of points, and wherein a stamp pattern can be formed by irradiating said first porous sheet with light through an original sheet, so that pores of an irradiated portion of said first porous sheet are sealed and thereby block transmission of ink, while pores of a non-irradiated portion of said first porous sheet remain open and thereby allow transmission of ink.

7. The stamp member according to claim 6, wherein a compressive strength of said second porous sheet being not less than 10 kg/cm$^2$ when said second porous sheet is compressed by 25%.

8. The stamp member according to claim 6, wherein said first and second porous sheets are fixed by means of an adhesive agent.

9. The stamp member according to claim 6, further comprising a third porous sheet, said third porous sheet is attached to said second porous sheet at an opposing side to said first sheet.

10. The stamp member according to claim 9, wherein a plurality of through-holes are formed on said third porous sheet.

11. The stamp member according to claim 9, wherein said third porous sheet is made of porous polyvinyl formal.

12. The stamp member according to claim 6, wherein said first porous sheet is made of porous resin.

13. The stamp member according to claim 12, wherein said first porous sheet is made of polyurethane resin.

14. The stamp member according to claim 6, wherein a spacer is provided to said second porous sheet at an opposing side to said first porous sheet, and wherein said spacer has a plurality of through-holes which allow ink to reach said first porous sheet.

15. The stamp member according to claim 6, wherein a melting point of said first porous sheet is from 50 to 200° C., wherein a sponge hardness of said first porous sheet is from 20 to 50 degrees, and wherein an average pore size of said first porous sheet is from 0.01 to 0.05 mm.

16. The stamp member according to claim 6, wherein said plurality of points are located in rows at a predetermined pitch.

17. The stamp member according to claim 6, wherein a thickness of said first porous sheet is from 0.5 to 2 mm, and wherein a thickness of said second porous sheet is from 0.5 to 4 mm.

18. The stamp member according to claim 6, wherein light energy absorbing material is dispersed in said first porous sheet.

19. The stamp member according to claim 18, wherein said light energy absorbing material is carbon black.

* * * * *

UNITED STATES PATENT AND TRADEMARK OFFICE

CERTIFICATE OF CORRECTION

PATENT NO. : 6,000,335

DATED : December 14, 1999

INVENTOR(S) : Teruo Imamaki et al.

It is certified that error appears in the above-identified patent and that said Letters Patent is hereby corrected as shown below:

On the title page, item [54], and Col. 1, lines 1-2, please change the title to read:
STAMP MEMBER

Signed and Sealed this

Fifteenth Day of August, 2000

*Attest:*

*Attesting Officer*

Q. TODD DICKINSON

*Director of Patents and Trademarks*